United States Patent [19]

Petit et al.

[11] 4,125,642

[45] Nov. 14, 1978

[54] METHOD FOR CONDUCTING ELECTROLESS METAL-PLATING PROCESSES

[75] Inventors: George S. Petit; Ralph R. Wright, both of Oak Ridge, Tenn.

[73] Assignee: The United States of America as represented by the United States Department of Energy, Washington, D.C.

[21] Appl. No.: 827,658

[22] Filed: Aug. 25, 1977

[51] Int. Cl.[2] ..... C23C 3/02

[52] U.S. Cl. ..... 427/8; 134/3; 204/195 F; 204/292; 427/401; 427/430 A; 427/438

[58] Field of Search ..... 427/437; 427/8, 430 A, 427/437, 438, 401; 134/3; 204/195 F, 292

[56] References Cited

U.S. PATENT DOCUMENTS

| | | | |
|---|---|---|---|
| 2,874,083 | 2/1959 | Metheny | 148/33.5 |
| 3,903,319 | 9/1975 | El-Mohamad | 427/438 |
| 3,934,054 | 1/1976 | Schmeling | 427/437 |

OTHER PUBLICATIONS

Greene et al., "Evaluating the Condition of Electroless Plating Baths", IBM Technical Disclosure Bulletin, vol. 7, No. 3, 8-1964.

Pearlstein, "Electroless Plating", Modern Electroplating, John Wiley & Sons, © 1974, pp. 710 to 714.

*Primary Examiner*—John D. Smith

*Attorney, Agent, or Firm*—Dean E. Carlson; Stephen D. Hamel; Fred O. Lewis

[57] ABSTRACT

This invention is an improved method for conducting electroless metal-plating processes in a metal tank which is exposed to the plating bath. The invention solves a problem commonly encountered in such processes: how to determine when it is advisable to shutdown the process in order to clean and/or re-passivate the tank.

The new method comprises contacting the bath with a current-conducting, non-catalytic probe and, during plating operations, monitoring the gradually changing difference in electropotential between the probe and tank. It has been found that the value of this voltage is indicative of the extent to which nickel-bearing decomposition products accumulate on the tank. By utilizing the voltage to determine when shutdown for cleaning is advisable, the operator can avoid premature shutdown and at the same time avoid prolonging operations to the point that spontaneous decomposition occurs.

5 Claims, 1 Drawing Figure

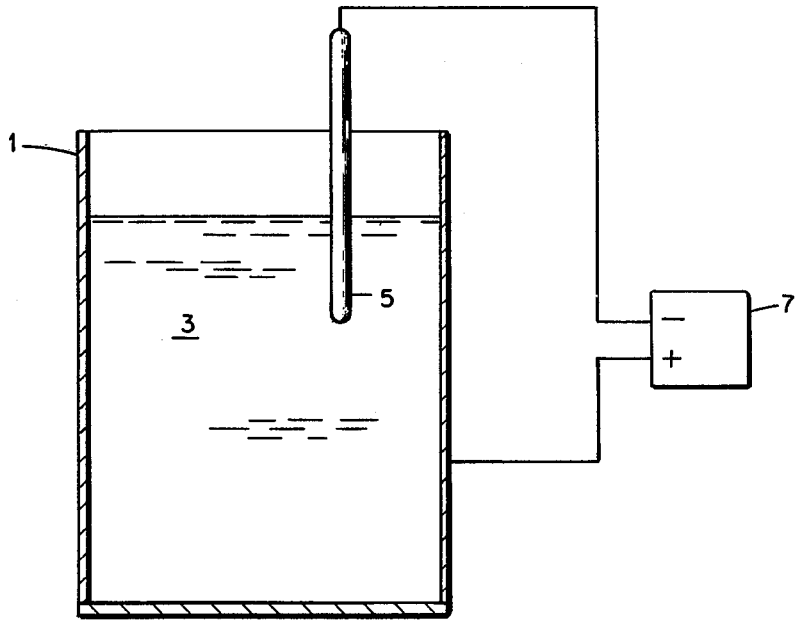
1
3
5
7
−
+

METHOD FOR CONDUCTING ELECTROLESS METAL-PLATING PROCESSES

BACKGROUND OF THE INVENTION

This invention was made in the course of, or under, a contract with the U.S. Energy Research and Development Administration.

The invention relates generally to processes for the nickel plating of catalytic materials by contacting them with hot plating baths of the nickel cation-hypophosphite anion type. Such processes are commonly referred to as electroless nickel plating, chemical nickel plating and chemical-reduction nickel plating. More particularly, the invention relates to an improved method for conducting such processes when the plating bath, or solution, is contained in a metal vessel in contact therewith.

The electroless nickel plating process is described in detail in such references as the following: ASTM Special Technical Publication No. 265, "Symposium on Electroless Nickel Plating, " 1965; G. Gutzeit, "An Outline of the Chemistry Involved in the Process of Catalytic Nickel Deposition from Aqueous Solution," Plating, October 1959, p. 1158–1164; and U.S. Pat. No. 2,658,839, "Process of Chemical Nickel Plating," issued Nov. 10, 1953. As used herein, the terms "catalyst" and "catalytic" refer to materials which catalyze an electroless metal-plating reaction--e.g., such metals as iron, cobalt, nickel, ruthenium, rhodium, palladium, osmium, iridium, and platinum. Workpieces composed of a catalytic material may be directly plated by contact with the plating bath. Workpieces composed of certain other metals can be plated by first providing them with a coating of a catalytic material. The term "nickel" is used herein to include both nickel and nickel phosphide. The term "metal" is used to include metals and metal alloys.

Electroless nickel plating commonly is conducted in highchromium-content steel tanks (e.g., stainless steel tanks) whose interior periodically passivated, or deactivated, by pre-treatment with dilute nitric acid solution, as taught in U.S. Pat. No. 2,874,083, to Matheny et al, Feb. 6, 1959. In the course of a typical electroless nickel plating operation, various decomposition products gradually build up on the tank. Because of further decomposition of these products and because of random chemical nickel plating, the products contain nickel which catalyzes the principal plating reaction. As a result, nickel plates upon this nickel until plating operations are terminated. If the plating operations are conducted for an extended period without removal of the decomposition products, spontaneous decomposition of the bath will occur. Thus, the tank must be cleaned periodically and sometimes be re-passivated. Unfortunately, there has been no convenient and accurate way to determine when it is advisable to terminate a plating operation and treat the tank with dilute nitric acid to remove the decomposition products and, if desired, re-passivate the tank. In the absence of an accurate indication of the condition of the tank surfaces, plating operations may be terminated before conditions really require it. On the other hand, operations may be continued inadvertently to the point where spontaneous decomposition occurs; in that event, the parts being plated are spoiled and the entire plating bath must be replaced.

OBJECTS OF THE INVENTION

Accordingly, it is an object of this invention to provide an improved method for conducting electroless plating operations in a metal tank exposed to the plating bath.

It is another object to provide a reliable method for generating, in the course of an electroless plating operation, a display indicative of the extent to which nickel-bearing decomposition products have accumulated on tank surfaces.

It is another object to provide a method for monitoring such plating operations to determine when operations should be terminated for removal of decomposition products from tank surfaces and, if desired, re-passivation of the tank.

SUMMARY OF THE INVENTION

In an electroless plating process for depositing a selected metal on a catalytic surface selected from metals of the group consisting of iron, cobalt, nickel, ruthenium, rhodium, palladium, osmium, iridium, and platinum, and utilizing a plating bath including an aqueous solution containing a water-soluble salt of said metal and a hypophosphite reducing agent for said salt, said process being conducted in a nitric-acid-passivated stainless-steel tank in contact with said bath, the improvement comprising: inserting in said bath an electrically conductive probe having a surface which is non-catalytic and non-reactive with respect to the plating bath, monitoring the difference in electropotential between said probe and said tank in the course of the plating process, and terminating the plating process when said difference reaches a preselected value.

BRIEF DESCRIPTION OF THE DRAWING

The single drawing is a schematic diagram of a chemical-reduction nickel plating system designed in accordance with this invention.

BRIEF DESCRIPTION OF THE PREFERRED EMBODIMENT

This invention is generally applicable to electroless processes for the deposition of metals from an alkaline or acid plating baths of the metal cation-hypophosphite anion type. The invention is applicable to any metal which can be so deposited, but for brevity it will be illustrated herein as applied to the deposition of nickel.

This method for conducting electroless metal plating is based on our finding that if an appropriate current-conducting probe is inserted in the bath during plating, the difference in electropotential between the probe and the tank is indicative of the condition of the tank surfaces in contact with the bath. That is, the difference in potential is a reliable indicator of the extent to which nickel has plated upon decomposition products deposited on the tank.

Our method can be illustrated in terms of the accompanying FIGURE, wherein the numeral 1 designates a conventional nitric-acid-passivated stainless steel tank containing a conventional plating bath 3 of the nickel cation-hypophosphite anion type. In accordance with this invention, a chrome-plated stainless steel probe 5 is mounted to contact the plating solution but not the tank. Also, a suitable voltmeter 7, such as a galvanometer, is connected across the probe and tank.

Using such a system, we have found that at the beginning of a typical run made with a freshly passivated tank, the tank initially is positive relative to the probe (see the figure), the initial probe-to-tank difference in potential being relatively small. As the run progresses, the initial difference in potential decreases to zero and reverses polarity; then, without again changing polarity, it slowly increases. If the plating operation is continued indefinitely, the difference in potential continues to increase slowly until spontaneous decomposition occurs. Consequently, tests can be conducted in a given plating system to determine which voltage values correspond to various conditions in the system--especially the voltage values which prevail as spontaneous decomposition is approached. In subsequent operations of that system, the probe-to-tank voltage can be monitored continuously, and the plating operation can be conducted until the voltmeter indicates that the buildup of the nickel on decomposition-products deposits has reached a preselected level or limit. At that time, the run is terminated and the tank is re-treated with dilute nitric acid to (1) remove the decomposition products or (2) remove the decomposition products and re-passivate the tank. This mode of operation utilizes the plating bath more efficiently, because the bath can be used long without risking spontaneous decomposition. Another advantage of the method is that the operator can determine from the voltmeter reading whether the tank is "clean" enough to permit a new workpiece to be immersed in the bath and completely plated before shutdown of the system is necessary. This is important because satisfactory plating of a workpiece is not achieved if the operation is stopped and then continued with another bath.

The following is a more detailed example of our method as employed in an experimental run conducted in a batchwise electroless nickel plating system of the kind illustrated generally in the figure. The system was operated to nickel-plate steel workpieces.

EXAMPLE

In this instance, the tank 1 was composed of stainless steel. The interior of the tank has been freshly passivated by conventional pre-treatment with nitric acid. (See above-referenced U.S. Pat. No. 2,874,083; e.g., col. 4, lines 35–45.) The plating solution was a conventional acid electroless plating bath having the following composition:

- 0.085 moles/liter nickel sulfate
- 0.25 moles/liter sodium hypophosphite
- 0.50 moles/liter lactic acid
- 0.50 moles/liter sodium hydroxide
- 1.5 moles/liter No. 7 "antipit" (M & T Chemical Company)
- 0.5 PPM $Pb^{++}$
- 4.5 ±0.2 pH with sodium hydroxide The bath was maintained at a temperature in the range of 50° C. to 100° C. and was stirred continuously. At times, a stabilizer ($Pb^{++}$) was added to the bath to help prevent spontaneous decomposition, and the concentrations of the other chemicals in the bath were maintained at selected values. Throughout the run, the plating conditions were controlled in accordance with conventional electroless nickel plating practice.

The probe 5 comprised a stainless steel rod which had been treated by conventional anodic pickling and then plated in a conventional chrome-plating bath to provide porosity--free chrome plate having a thickness of 4 mils. The voltmeter 7 was a conventional high-impedance-follower amplifier driving a Leeds and Northrop Corporation "Speedomax G" recorder. Center-scale zero on the recorder permitted the recording of potentials of both polarities.

At the start of the plating operation, the freshly passivated tank 3 was positive relative to the probe, and at this time the recorded probe-to-tank voltage was +.25 volts. (We have found that in such systems, it is typical for this initial value to be in the range of +0.02 to 0.25.) As the run continued, the recorded value decreased to zero, reversed polarity, and gradually increased. The rate of the change of the voltage is a function of the amount of plating (mils/ft$^2$) as well as the condition of the bath. Eighty hours after the start of operations the voltage had increased to −0.4 volt. After four more hours of operation, spontaneous decomposition occured, at which time the recorded voltage was −0.6 volt. Similar runs conducted with this particular system confirmed that spontaneous decomposition typically occurs at essentially −0.6 volt. Thus, in this type of system we prefer to terminate the typical run when the voltage is at a somewhat lower value in the range of approximately −0.35 to −0.5 volts--as, for instance, a preselected value of −0.4 volt.

We surmise that the above-mentioned voltage changes occur at least in part because of the gradual change in the composition of the tank surface exposed to the plating bath. For instance, at the beginning of the run the electrodes of the probe-to-tank cell consist essentially of chrome (the probe) and oxide-coated stainless steel (the passivated tank). As the run progresses, more and morenickel plates out on the decomposition-products deposits, and the cell approaches a chrome-nickel cell.

While we prefer to employ a probe 5 having a chrome surface, the surface may consist of other non-catalytic, conductive materials. The probe may be saturated calomel electrode or any electrically conductive member whose surface is non-catalytic and non-reactive with respect to the plating solution. Any suitable continuous or intermittent voltage-responsive device may be employed to display, record, or otherwise utilize the probe-to-tank voltage. Our method is applicable both to batch and continuous plating. We have found that our method not only can be used to determine when a plating run should be terminated but also to determine when a chemical stabilizer should be added to the solution. In the latter instance, we prefer to supplement our method with the usual chemical analyses. Another advantage of the method is related to the fact that a workpiece may sometimes contact the tank momentarily, causing some plating of nickel on the tank; if not corrected for, this will shorten the expected use of the plating tank and bath. Despite such an occurance, our method will accurately determine when the run should be terminated.

As mentioned above, the plating tank may be re-passivated with dilute nitric acid solution in accordance with the above-referenced U.S. Pat. No. 2,874,073. Removal of decomposition products from the tank can be accomplished by the same treatment but conducted under less severe conditions. For example, decomposition products may be removed from the tank surfaces by contacting the same with static or circulated 0.1N nitric acid solution for a shorter time than is required for re-passivation.

It will be apparent to one versed in the art that our method is not limited to systems for the chemical plating of nickel but also is applicable to systems for the chemical plating of other metals—e.g., copper, cobalt, and palladium. Thus, in a system for the chemical plating of copper, our method can be used to monitor the buildup of copper on the decomposition products deposited on surfaces of the tank. The probe-to-tank voltage values characteristic of that system will, of course, be somewhat different from those cited herein for a system for chemically plating nickel.

What is claimed:

1. In an electroless plating process for depositing a selected metal on a catalytic surface selected from metals of the group consisting of iron, cobalt, nickel, ruthenium, rhodium, palladium, osmium, iridium, and platinum, and utilizing a plating bath including an aqueous solution containing a water-soluble salt of said metal and a hypophosphite reducing agent for said salt, said process being conducted in a nitric-acid-passivated stainless-steel tank in contact with said bath, the improvement comprising:

inserting in said bath an electrically conductive probe having a surface of chrome, which is non-catalytic and nonreactive with respect to the plating bath;

monitoring the difference in electropotential between said probe and said tank in the course of the plating process; and terminating the plating process when said difference reaches a preselected value.

2. The method of claim 1 wherein said preselected value is in the range of from aproximately −0.35 to −0.5 volt.

3. In an electroless plating process for depositing a metal on a catalytic surface selected from metals of the group consisting of iron, cobalt, nickel, ruthenium, rhodium, palladium, osmium, iridium, and platinum, and utilizing a plating bath including an aqueous solution containing a water-soluble salt of said metal and a hypophosphite reducing agent for said salt, said process being conducted in a stainless steel tank whose interior has been passivated by pre-treatment with nitric acid, the improvement comprising:

inserting in said bath an electrically conductive probe having a chrome surface;

monitoring the difference in electropotential between said probe and said tank in the course of the plating process;

terminating the plating process when said difference reaches a preselected value indicating that buildup of said metal on decomposition-product deposits has reached a selected limit;

draining said tank; and treating said tank with dilute nitric acid solution to remove decomposition products therefrom.

4. In an electroless plating process for depositing nickel on a catalytic surface selected from metals of the group consisting of iron, cobalt, nickel, ruthenium, rhodium, palladium, osmium, iridium and platinum, and utilizing a plating bath including an aqueous solution containing a water-soluble salt of nickel and a hypophosphite reducing agent for said salt, said process being conducted in a stainless steel tank in contact with said bath, the improvement comprising:

inserting in said bath an electrically conductive probe having a chrome surface;

monitoring the difference in electropotential between said probe and said tank in the course of the plating process; and terminating the plating process when said difference in electropotential has successively (a) decreased to zero (b) reversed polarity, and (c) increased to a preselected value having said reversed polarity.

5. The method of claim 4 wherein said preselected value is in the range of approximately −0.35 to −0.5 volt.

* * * * *